US007703361B2

(12) United States Patent
Johnson et al.

(10) Patent No.: US 7,703,361 B2
(45) Date of Patent: Apr. 27, 2010

(54) SHAVING RAZORS AND CARTRIDGES

(75) Inventors: Robert Johnson, Melrose, MA (US); Robert A. Trotta, Pembroke, MA (US); Kelly Bridges, N. Quincy, MA (US); Corby E. Corbeil, Attleboro, MA (US); Richard Hart Luxton, Leighton Buzzard Beds (GB); Roy Nicoll, Workinghman (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 11/471,903

(22) Filed: Jun. 21, 2006

(65) Prior Publication Data

US 2006/0236546 A1 Oct. 26, 2006

Related U.S. Application Data

(63) Continuation of application No. 10/969,373, filed on Oct. 20, 2004, now abandoned.

(51) Int. Cl.
*B26B 19/40* (2006.01)
*B26B 21/00* (2006.01)

(52) U.S. Cl. ..... 83/13; 30/41; 30/50; 30/77

(58) Field of Classification Search ..... 30/32, 30/41, 50, 73, 77, 79, 526, 537, 538, 540; D28/47

See application file for complete search history.

(56) References Cited

U.S. PATENT DOCUMENTS

| | | | | | |
|---|---|---|---|---|---|
| 979,296 | A | * | 12/1910 | Heissenberger | 30/41 |
| 1,633,139 | A | * | 6/1927 | Staats-Oels | 30/50 |
| 1,741,891 | A | * | 12/1929 | Vallon | 30/41 |
| 1,935,452 | A | * | 11/1933 | Kondolf | 30/73 |
| 2,004,086 | A | * | 6/1935 | Testi | 30/526 |
| 2,677,883 | A | | 5/1954 | Schallgruber | |
| 2,840,901 | A | * | 7/1958 | Narrizzano | 30/73 |
| 2,861,338 | A | * | 11/1958 | Boland | 30/41 |
| 3,138,865 | A | * | 6/1964 | Meyer | 30/41 |
| 3,183,589 | A | * | 5/1965 | Szabo | 30/30 |
| 3,593,416 | A | * | 7/1971 | Edson | 30/50 |
| 3,768,161 | A | * | 10/1973 | Miller | 30/41 |
| 3,895,437 | A | * | 7/1975 | DiBuono | 30/537 |
| 3,969,817 | A | | 7/1976 | DiBuono | 30/41 |
| 4,074,429 | A | | 2/1978 | Roberts | 30/41 |
| 4,170,821 | A | | 10/1979 | Booth | 30/41 |
| 4,314,404 | A | | 2/1982 | Ruiz et al. | 30/41 |
| 4,562,644 | A | | 1/1986 | Hitchens | 30/41 |
| 4,683,096 | A | | 7/1987 | Ferraro | |
| 4,901,437 | A | * | 2/1990 | Iten | 30/50 |
| 4,932,123 | A | | 6/1990 | Francis | 30/77 |

(Continued)

FOREIGN PATENT DOCUMENTS

| | | |
|---|---|---|
| EP | 0 960 699 A1 | 1/1999 |

(Continued)

*Primary Examiner*—Jason Daniel Prone
(74) *Attorney, Agent, or Firm*—Joanne N. Pappas; Kevin C. Johnson; Steven W. Miller

(57) ABSTRACT

Shaving razors and cartridges are featured that include one or more shaving aid portions. In some instances, the razors and cartridges include a shaving aid holder, configured to allow the shaving aid portion to deflect when pressure is applied to a surface of the shaving aid portion during shaving.

38 Claims, 14 Drawing Sheets

U.S. PATENT DOCUMENTS

| | | | | |
|---|---|---|---|---|
| 4,944,090 | A | 7/1990 | Sumnall | |
| 5,134,775 | A | 8/1992 | Althaus et al. | 30/41 |
| 5,168,628 | A * | 12/1992 | Mock et al. | 30/41 |
| 5,369,885 | A * | 12/1994 | Ferraro | 30/41 |
| 5,671,534 | A | 9/1997 | Mayerovitch | 30/41 |
| 6,145,201 | A | 11/2000 | Andrews | 30/50 |
| 6,161,287 | A * | 12/2000 | Swanson et al. | 30/50 |
| 6,216,345 | B1 | 4/2001 | Andrews | 30/50 |
| D462,142 | S | 8/2002 | Dombrowski et al. | D28/48 |
| D462,143 | S | 8/2002 | Dombrowski et al. | D28/48 |
| 6,553,641 | B1 | 4/2003 | Garland et al. | 29/428 |
| 6,584,690 | B2 | 7/2003 | Orloff et al. | 30/41 |
| 6,655,028 | B2 | 12/2003 | Coffin | 30/41 |
| 7,086,159 | B2 * | 8/2006 | Motta et al. | 30/526 |
| 7,103,976 | B2 * | 9/2006 | Pennella | 30/32 |
| 7,178,241 | B1 * | 2/2007 | Cummings et al. | 30/41 |
| D547,494 | S * | 7/2007 | Watson et al. | D28/47 |
| D556,378 | S * | 11/2007 | Watson et al. | D28/47 |
| 7,540,088 | B2 * | 6/2009 | Takeshita | 30/77 |
| 2002/0157255 | A1 | 10/2002 | Coffin | 30/41 |
| 2003/0014866 | A1 | 1/2003 | Orloff et al. | 30/41 |
| 2003/0121154 | A1 | 7/2003 | Orloff et al. | 30/41 |
| 2003/0167644 | A1 | 9/2003 | Motta et al. | 30/526 |
| 2003/0200659 | A1 | 10/2003 | Coffin et al. | 30/47 |
| 2003/0200660 | A1 | 10/2003 | Pennella et al. | 30/47 |
| 2004/0010918 | A1 | 1/2004 | Orloff et al. | 30/41 |
| 2004/0055157 | A1 | 3/2004 | Barone et al. | 30/41 |
| 2005/0278954 | A1 | 12/2005 | Orloff et al. | 30/32 |
| 2006/0005394 | A1 * | 1/2006 | Newkirk et al. | 30/50 |
| 2006/0080837 | A1 * | 4/2006 | Johnson et al. | 30/50 |
| 2006/0080838 | A1 * | 4/2006 | Johnson et al. | 30/50 |
| 2006/0143925 | A1 * | 7/2006 | Johnson et al. | 30/50 |
| 2007/0110703 | A1 * | 5/2007 | O'Grady et al. | 30/34.2 |
| 2008/0209734 | A1 * | 9/2008 | Nicoll | 30/41 |

FOREIGN PATENT DOCUMENTS

| | | | |
|---|---|---|---|
| FR | 1484360 | B26 | 6/1967 |
| GB | 2 200 587 | | 8/1988 |
| GB | 2 248 033 | A | 3/1992 |
| WO | WO 01/60572 | A1 | 8/2001 |
| WO | WO 2004/071260 | A2 | 8/2004 |
| WO | WO 2005/082584 | A1 | 9/2005 |
| WO | WO 2007056509 | A1 * | 5/2007 |

* cited by examiner

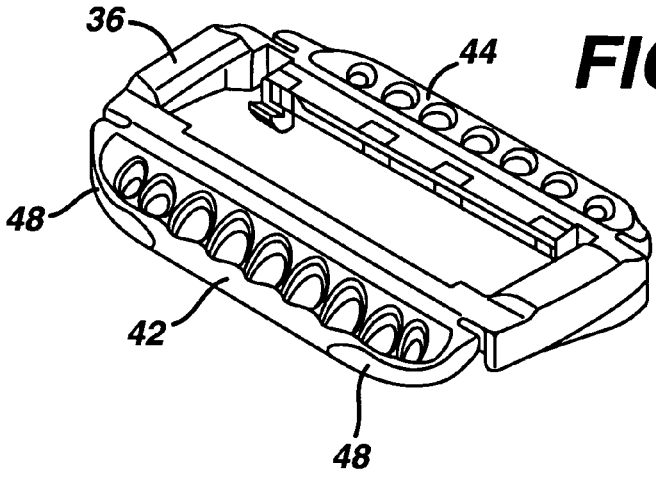
FIG. 4
FIG. 4A
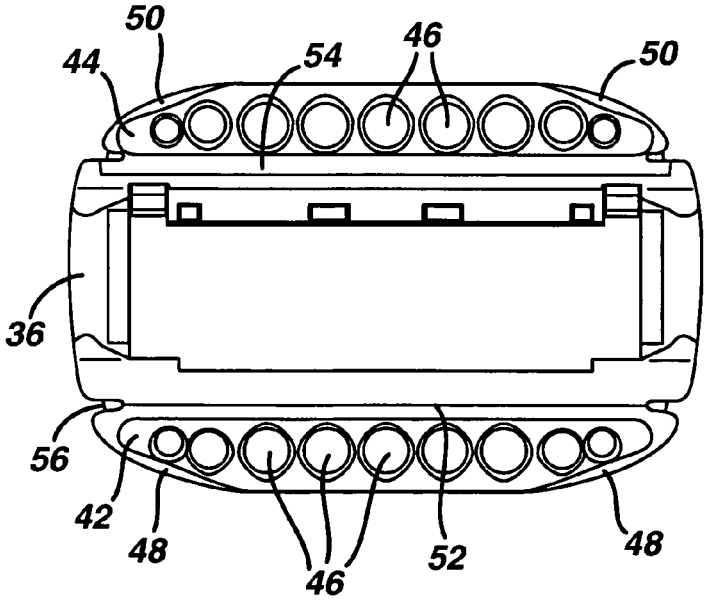
FIG. 4C
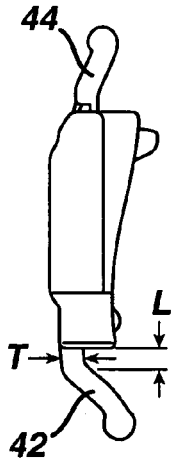
FIG. 4B
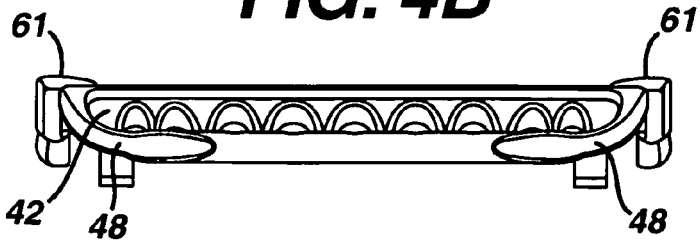

SHAVING RAZORS AND CARTRIDGES

Under 35 USC §120, this application relies on the earlier filing date of application Ser. No. 11/366,228, filed on Mar. 2, 2006, which is a continuation of Ser. No. 10/969,373, filed on Oct. 20, 2004.

CROSS REFERENCE TO RELATED APPLICATIONS

This application is a continuation, and claims the benefit of priority from U.S. patent application Ser. No. 10/969,373, filed Oct. 20, 2004 now abandoned, the contents of which is hereby incorporated by reference herein in its entirety.

TECHNICAL FIELD

This invention relates to shaving razors and cartridges.

BACKGROUND

Razors for wet shaving typically include a blade unit carried by a handle, the blade unit including an elongate blade with a rectilinear sharpened edge, or a plurality of such blades with parallel edges. The blade unit may be fixedly mounted on the handle with the intention that the entire razor be discarded when the blade edge or edges have become dulled. Alternatively, the blade unit can be detachably connected to the handle to enable replacement of a used blade unit with a fresh blade unit. Replaceable blade units are commonly referred to as cartridges.

Some shavers, in particular women, use this type of razor in the shower. For example, when shaving her legs a woman will often apply a film or lather of soap to an area of skin to be shaved, shave that area, apply soap to another area, and shave that area. This process is repeated until shaving is complete. Shaving in this manner may be difficult and frustrating, as it generally requires the shaver to hold a wet bar of soap in one hand while wielding a razor in the other hand, often while standing in an awkward position on a slippery shower floor.

Attempts have been made to address this problem by providing soap mounted on a razor. For example, U.S. Pat. No. 6,584,690 describes a razor that carries a shaving preparation, e.g., in the form of a solid cake of soap that surrounds the cartridge.

SUMMARY

The present invention features razors and razor cartridges that deliver a shaving aid to a user's skin during shaving. In some implementations, the shaving aid includes a lubricating shaving preparation, allowing a user to easily shave in the shower or bath, without having to juggle a razor and a separate bar of soap. The razors provide good shaving performance, are comfortable to use, and tend to track well on the user's skin. In some implementations, the razors are configured to be easy to use in confined or hard to reach areas. In preferred razors, the cartridge is pivotally mounted on the handle, providing good maneuverability during shaving.

In one aspect, the invention features a shaving cartridge including (a) a housing having a front edge and a rear edge; (b) one or more shaving blades between the front edge and the rear edge; and (c) a shaving aid holder, carrying at least one solid shaving aid portion, mounted on said housing, the shaving aid holder being configured to allow the shaving aid portion to deflect when pressure is applied to a surface of the shaving aid portion during shaving.

In another aspect, the invention features a shaving cartridge including (a) a housing having a front edge and a rear edge; (b) one or more shaving blades between the front edge and the rear edge; and (c) a shaving aid holder, carrying a pair of solid shaving aid portions, mounted on said housing, wherein the two shaving aid portions have different compositions.

In a further aspect, the invention features a shaving cartridge including (a) a housing having a front edge and a rear edge; (b) one or more shaving blades between the front edge and the rear edge; and (c) a shaving aid holder, carrying at least one solid shaving aid portion, mounted on said housing, wherein the housing has a pair of side edges, and the shaving aid portion extends from 0 to 2 mm beyond each of the side edges.

In another aspect, the invention features a shaving razor including: a handle, and, pivotally mounted on the handle, a cartridge having any of the features described above.

The invention also features methods of shaving. For example, the invention features methods of shaving including contacting the skin with any of the razor cartridges described above. Some methods further include applying water to the skin during shaving.

The details of one or more embodiments of the invention are set forth in the accompanying drawings and the description below. Other features and advantages of the invention will be apparent from the description and drawings, and from the claims.

DESCRIPTION OF DRAWINGS

FIGS. 4-4C are, respectively, perspective, top, front and side views of the holder with the shaving aid portions removed.

DETAILED DESCRIPTION

Figure 1:
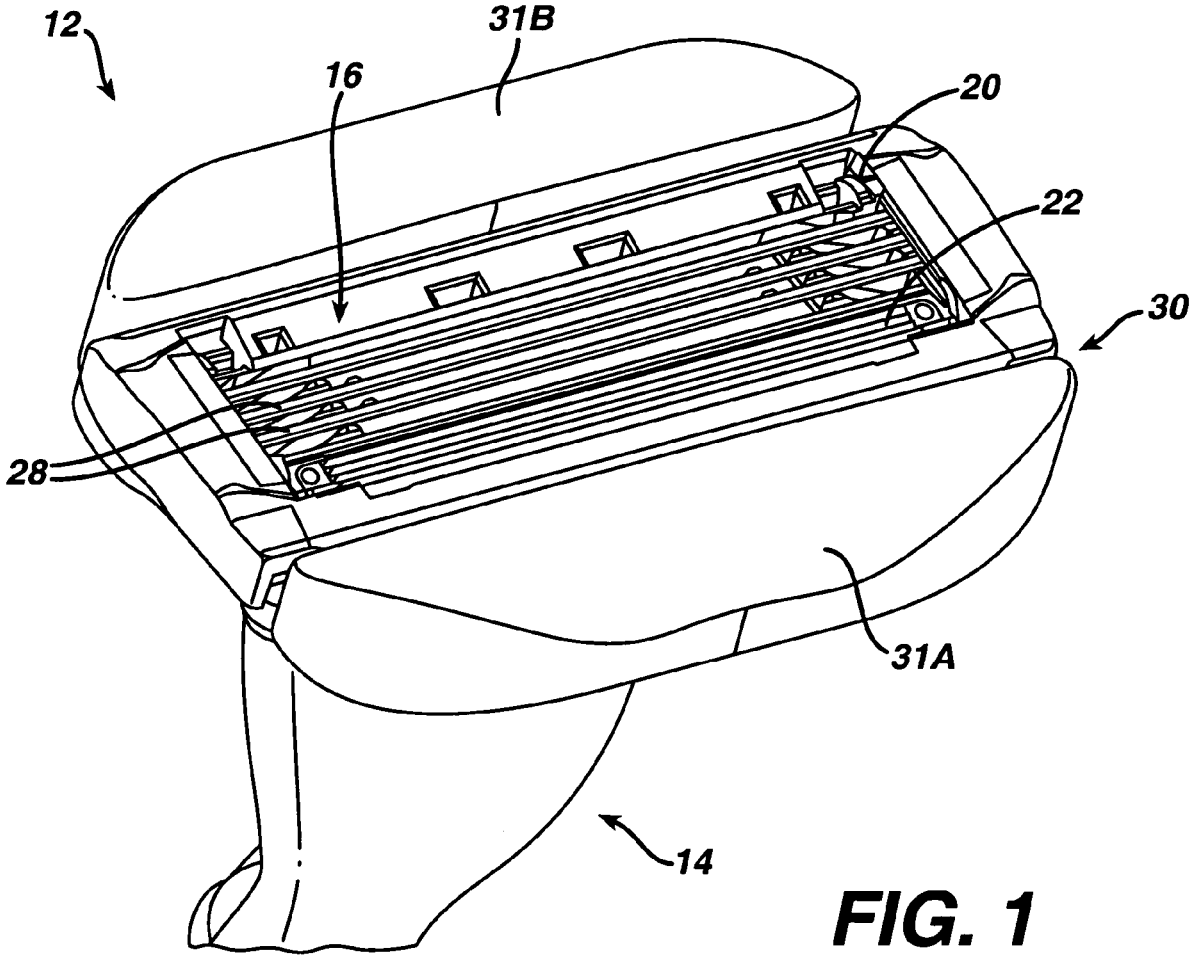
FIG. 1 is a perspective view of the head and neck portion of a razor according to one embodiment of the invention.
Figure 2:
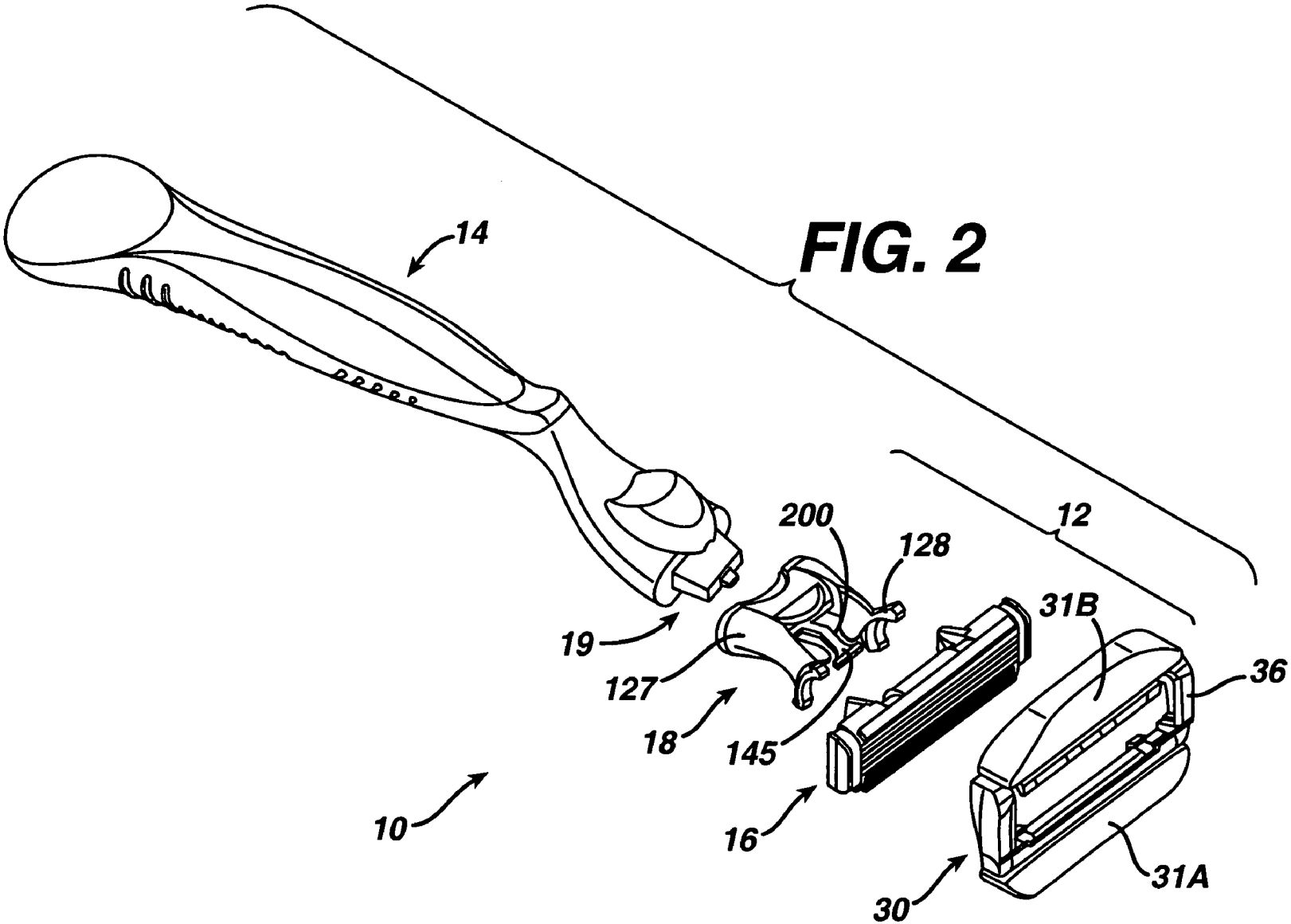
FIG. 2 is an exploded perspective view of the razor of FIG. 1.

Referring to FIGS. 1 and 2, a shaving razor 10 includes a disposable cartridge 12 and a handle 14. As shown in FIG. 2, cartridge 12 includes a connecting member 18, which removably connects cartridge 12 to a connecting portion 19 of handle 14, a blade unit 16, which is pivotally connected to connecting member 18, and a shaving aid holder 30 mounted on the blade unit 16. Referring to FIG. 1, the blade unit 16 includes a plastic housing 20, a guard 22 at the front of housing 20, and blades 28 between guard 22 and the rear of housing 20.

The blade unit 16 is similar to blade units described in U.S. Pat. No. 5,661,907, the complete disclosure of which is incorporated herein by reference. The handle 14 is similar to those described in U.S. Pat. Nos. 5,855,071, 5,956,851 and 6,052,903, the complete disclosures of which are incorporated herein by reference. The connecting member 18 that is used to connect blade unit 16 to handle 14 is discussed below.

As will be discussed in further detail below, the holder 30 carries a pair of shaving aid portions 31A, 31B. The front shaving aid portion 31A contacts the skin in front of the blades, i.e., before shaving, and the rear shaving aid portion 31B contacts the skin behind the blades. Thus, the shaving aid portions may have different compositions, for example the front shaving aid portion may include shave preparation ingredients such as lubricants, while the rear portion may include skin soothing and conditioning ingredients such as emollients and moisturizers.

Figure 3:
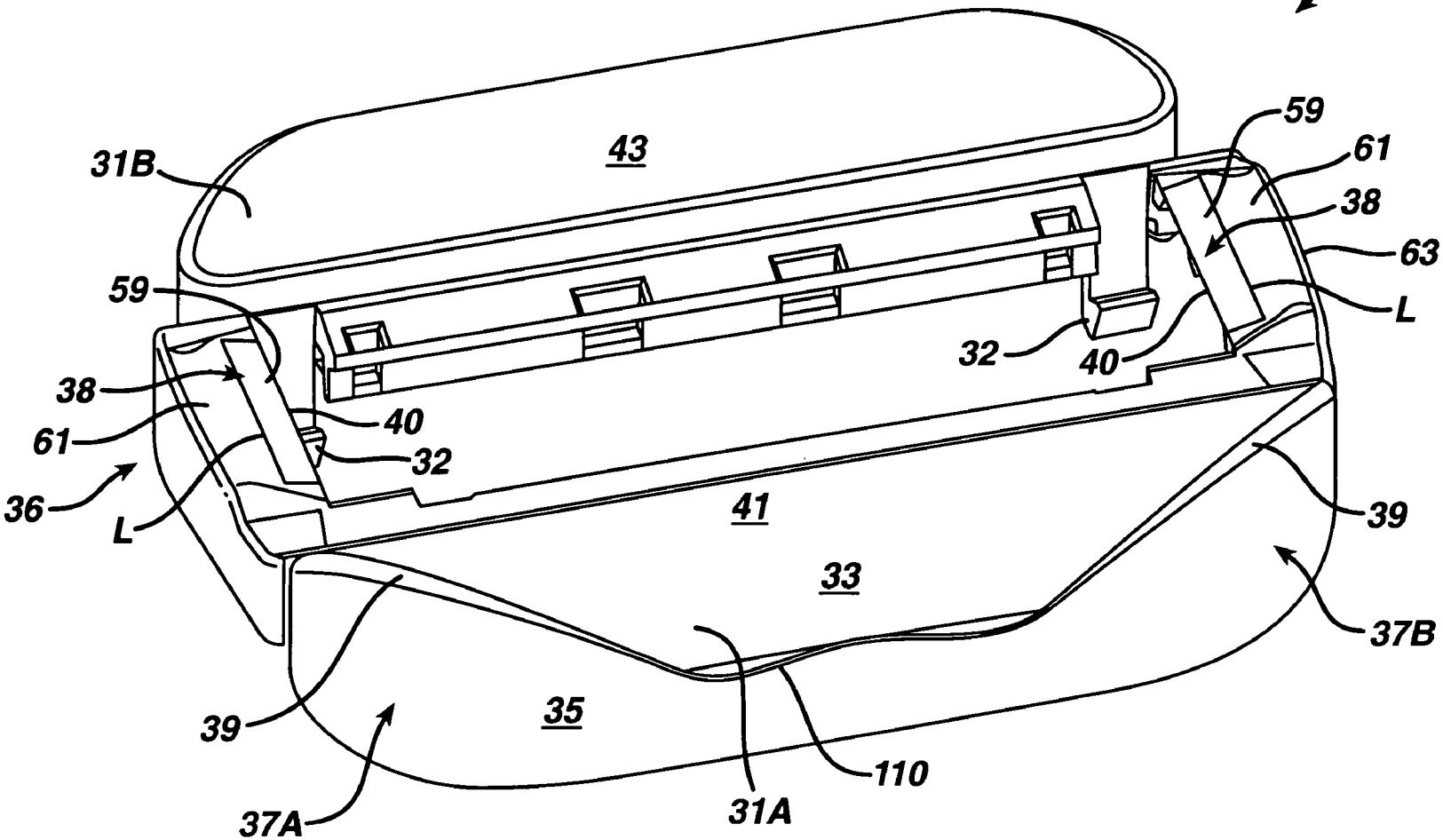
FIG. 3 is a perspective view of the holder portion of the cartridge shown in FIG. 1, viewed from above.
Figure 3A:
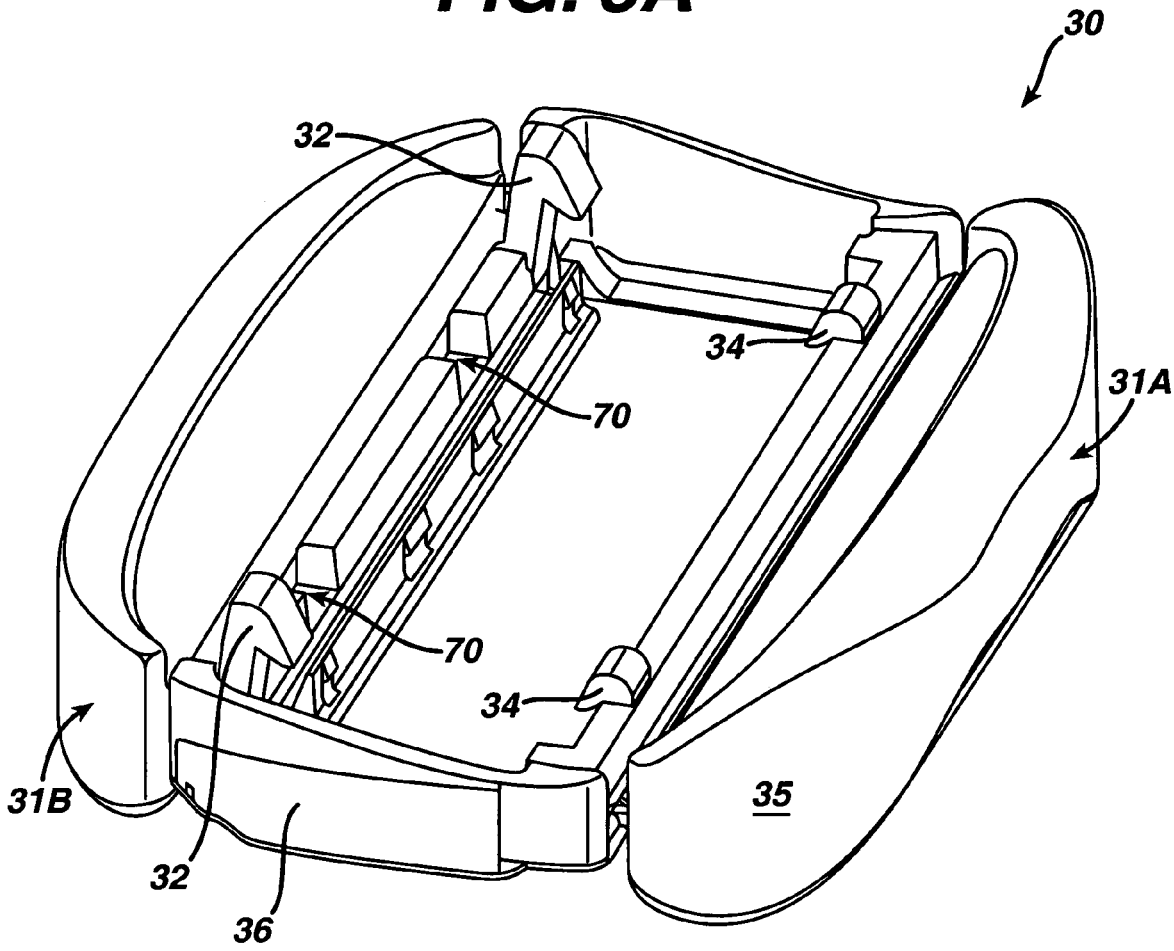
FIG. 3A is a persective view of the holder shown in FIG. 3, viewed from below.
Figure 3B:
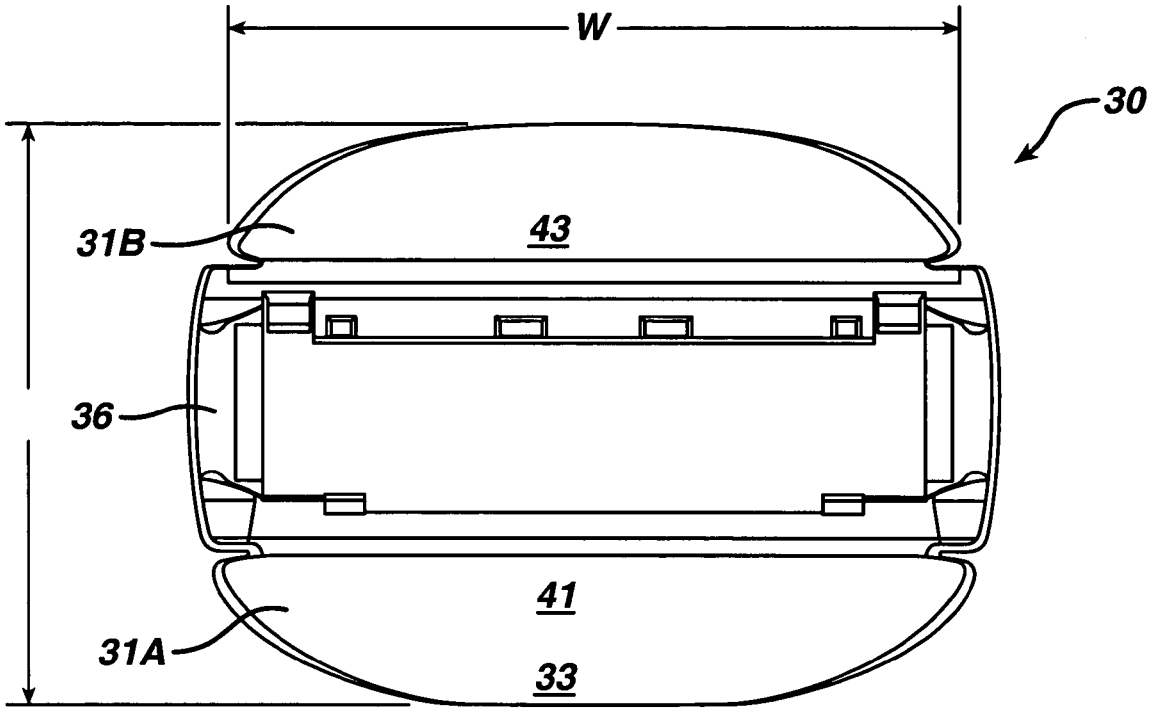
FIGS. 3B, 3C and 3D are, respectively, top, front and side views of the holder shown in FIG. 3.
Figure 3C:
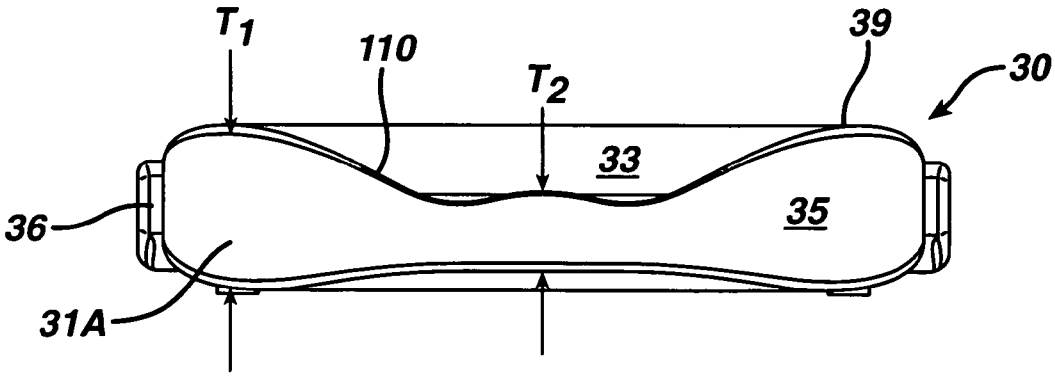
Figure 3D:
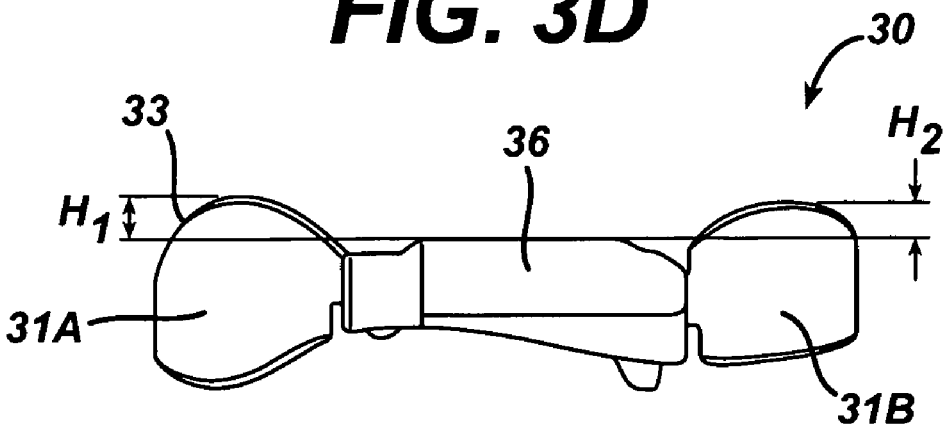
Figure 3E:
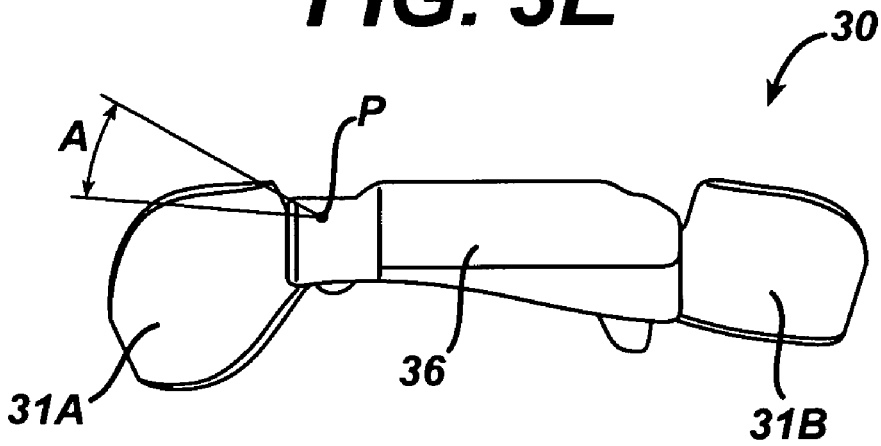
FIG. 3E is a side view showing the wings of the holder in a deflected position (the side mounts are shown in their normal position in FIG. 3D).

The shaving aid portions are mounted so that they will resiliently deflect upon contact with the skin, from a normal, undeflected position (FIG. 3D) to a flexed position (FIG. 3E). This deflection allows the razor to be easily used in hard to reach or confined areas, such as the armpit (axilla) or behind the knee. Deflection of the shaving aid portion also prevents premature wear of the shaving aid portion and discomfort to the user in cases where the user applies excessive pressure during shaving. Preferably, the angle of deflection (angle A, FIG. 3E) is at least about 10 degrees, e.g., from about 10 to 60 degrees, typically about 20 to 40 degrees. Angle A is measured by drawing a line from a pivot point P located in the approximate center of the elastomeric hinge to the highest point on the shaving aid portion 31A when the shaving aid portion is in its undeflected position, and measuring the angle between this line when the shaving aid portion is in its undeflected position and the same line when the shaving aid portion is deflected to its design limit. The resilient mounting of the shaving aid portions will be discussed in further detail below. The heights $H_1$ and $H_2$ of the shaving aid portions in the undeflected position (FIG. 3D) will vary, but may be, for example, from about 1 to 4 mm, e.g., about 1.5 to 3.0 mm. $H_1$ and $H_2$ are generally within about 0 to 50% of each other. Generally, the heights of the two shaving aid portions will be proportional to the wear rates of the compositions used, so that the shaving aid portions will be exhausted at approximately the same time.

Figure 1A:
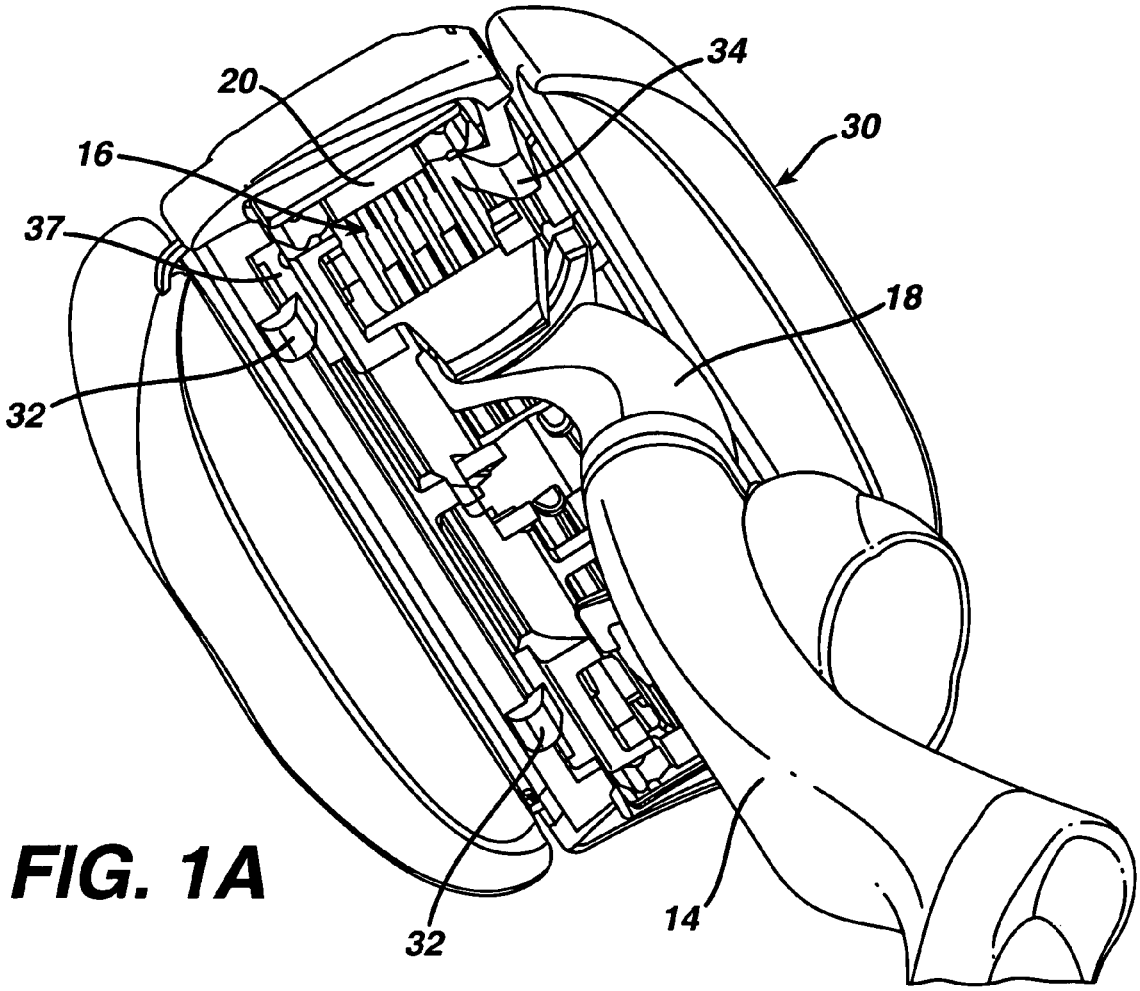
FIG. 1A is a perspective view of the head and neck portion shown in FIG. 1, viewed from the back.

The holder 30 may be mounted so that it is removable from the cartridge body by the consumer (e.g., if the consumer wishes to add a shaving aid holder to a cartridge that does not include one), or, alternatively, may be permanently mounted on the cartridge body or integrally molded with the cartridge body. In the embodiment shown in FIGS. 1-5C, the holder 30 clips onto the cartridge by engagement of clips 32 and 34 (FIG. 3A) with the back surface 37 of the housing 20 of the blade unit, as shown in FIG. 1A. The holder 30 may be engaged with the housing by sliding the housing under clips 34 and then deflecting clips 32 to snap them in place.

Various features of the cartridge 12 will now be described in further detail.

Structure of the Shaving Aid Holder

Referring to FIG. 3, shaving aid holder 30 includes a frame member 36 that extends around the periphery of the cartridge body when the holder 30 is in place. Generally, frame member 36 is formed of a molded plastic. Preferably, the sides 38 of the frame member extend over side regions of the cartridge body, to securely hold the holder in place. Sides 38 should generally be sufficiently thin, adjacent the blade ends, so that shaving performance is not compromised. Preferably, a ramped area is provided between the very thin edges 40 adjacent the blade ends to an area outboard of the edges. For example, the sides 38 generally have a thickness of less than 0.15 mm at edges 40, and less than 0.4 mm at line L, about 0.5 mm inboard of edges 40. This ramped area 59 provides rails 61, between line L and the outer side edge 63 of the holder 30, that may enhance tracking of the razor during use.

Referring to FIGS. 3D, 4-4C and 5-5C, shaving aid portions 31A and 31B are carried on a pair of wings 42, 44. Wings 42, 44 may be formed of the same plastic as the frame, or may be formed of a different material. For example, the wings may be formed of the same material as the hinges 52, 54 (FIG. 4A, discussed below) that join the wings and frame. In this case, the wings and hinges may be overmolded onto the frame in a single molding step.

The wings include a plurality of apertures 46 (FIG. 4A) that allow the shaving aid to flow through the thickness of the wing and form a mechanical interlock (e.g., by flowing together to form a unitary mass) on the back side of the wing, securing the shaving aid to the wing.

Elastomeric bumpers 48, 50 are provided at the corners of the wings, underlying the shaving aid portions, so that as the shaving aid portions are exhausted the user's skin will contact elastomer rather than hard plastic. Generally, the elastomeric bumpers have a thickness T (FIG. 5B) of at least 1 mm, e.g., about 1.5 to 3 mm. Preferably, the elastomer is relatively soft for user comfort and so that the hinge will have a soft flex. For example, the elastomer may have a hardness of less than about 50 Shore A, e.g., less than about 40 Shore A. The elastomer may be, for example, a block copolymer such as those available under the tradename KRATON. Preferably, the elastomer has sufficient chemical resistance so that it will not degrade during prolonged contact with the ingredients of the shaving aid composition.

Figure 5C:
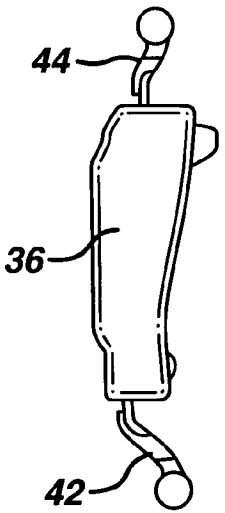
FIGS. 5-5C are, respectively, perspective, top, front and side views of the holder with the shaving aid portions and elastomeric portions removed.
Figure 5:
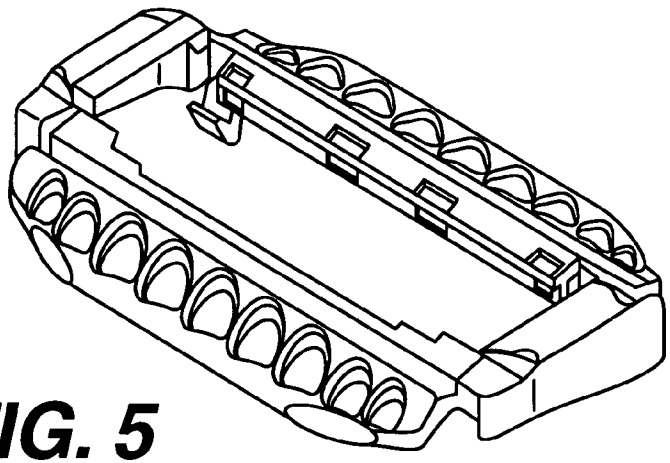

Referring to FIG. 5C, even in their normal, undeflected position, the wings 42, 44 curve downward, well below the plane defined by the blade edges. This curvature allows the wings to carry a relatively large amount of soap, without the upper surface of the shaving aid portion extending too far above the plane of the blade edges or the lowest area of the shaving aid portion being too low to ever contact the skin during use. Generally, the lowest point on each of the wings 42, 44 is at least about 1 mm below the plane defined by the blade edges, e.g., about 2 to 6 mm below this plane. If desired, e.g., if the shaving aid is relatively wear resistant, the wings may extend relatively straight from the frame.

Resilient Mounting of Shaving Aid Portions

Wings 42, 44 are resiliently mounted on the frame member 36, to allow deflection of the shaving aid portions 31A, 31B during shaving, from the normal position shown in FIG. 3D to the deflected position shown in FIG. 3E. Flexible hinges 52, 54 (FIG. 4A) provide this resilient connection between the wings and the frame.

Preferably, hinges 52, 54 are formed of an elastomeric material, e.g., a block copolymer. Typically, the hinges are formed of the same elastomeric material as the elastomeric bumpers 48, 50 discussed above. The elastomeric material is generally selected to provide a soft flex, so that the wings deflect readily upon contact with the user's skin, while also providing a good spring return to the wings. For example, the elastomeric material may have a flexural modulus of about 100 to 300 psi. The modulus that will provide the desired product characteristics will depend upon the thickness T and length L (FIG. 4C) of the hinges. The thickness and length of the two hinges can be the same or different, and these dimensions and the elastomeric material used can be selected to give the two wings desired flexural characteristics. The thickness of the hinges may be, for example, from about 0.5 to 2.0 mm and the length may be from about 0.5 to 3.0 mm. In the embodiment shown in FIGS. 4-4C, the hinges extend almost the full width of the holder 30. However, if desired, the hinges may be narrower or may consist of discontinuous hinge portions.

Figure 5A:
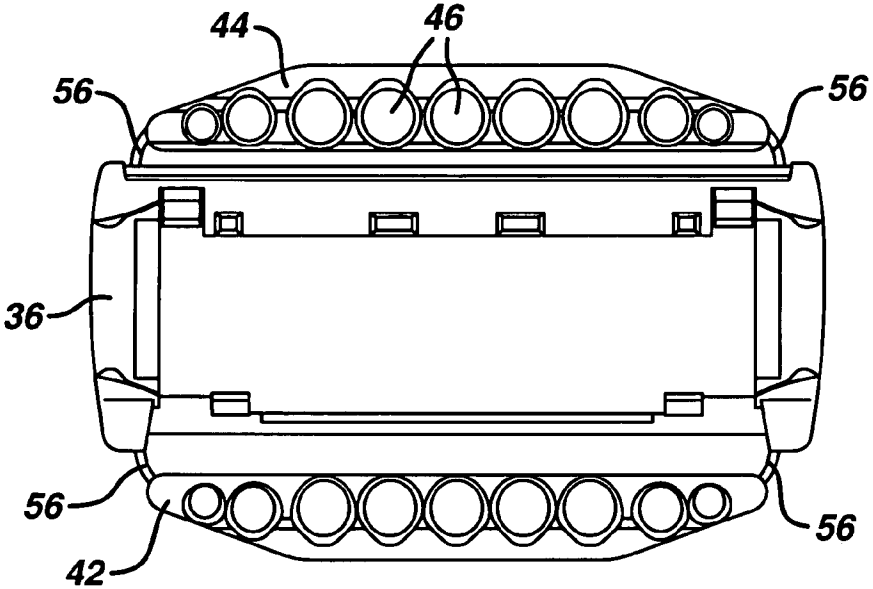
Figure 5B:
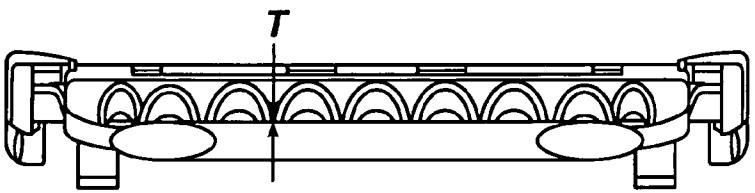

The elastomeric hinges may be overmolded onto the frame. To assist in this process, in the embodiment shown in FIGS. 4-5C, the frame is connected to each of the wings by a pair of connecting members 56 that extend integrally from the frame to the wings (FIG. 5A). If desired, these connecting members may be cut after overmolding has been completed. Alternatively, the wings and frame may be separate components that are placed in an insert mold and overmolded with elastomer. Forming the hinges solely of elastomer (i.e., substantially free of rigid plastic) may result in a softer flexing hinge in some cases.

Contouring of Shaving Aid Portions

Referring to FIG. 3D, the front shaving aid portion 31A includes a ramped leading surface 33 that is contoured to cause the shaving aid portion to deflect upon skin contact, so that the cartridge will not rock back when shaving aid portion 31A contacts the skin during shaving. As can be seen in FIGS. 3 and 3C, a leading edge 110 of the shaving aid portion 31A has a first thickness $t_1$ adjacent the side surfaces of the holder 30, and tapers to a second, lesser thickness $t_2$ adjacent a center region of the shaving aid portion. This shape allows the front shaving aid portion to have the ramped leading surface 33, while still providing as much shaving aid as possible adjacent the side surfaces. If desired, the entire leading edge could have the lesser thickness $t_2$. The front face 35 of the shaving aid portion 31A includes smoothly curved, arcuate side areas 37A, 37B, to enhance the soap-deflecting contour of leading surface 33 and to avoid edges and corners that could be uncomfortable during shaving and facilitate shaving of tight areas such as the underarm and behind the knee. Similarly, the intersections 39 of leading surface 33 and front face 35 are smoothly radiused.

Both the front shaving aid portion 31A and the rear shaving aid portion 31B are contoured so that the upper surface of each shaving aid portion (surface 41 of shaving aid portion 31A and surface 43 of shaving aid portion 31B) lies relatively flat against the user's skin when the wing 44 is deflected. This flat position, shown in FIG. 3E, allows as much shaving aid as possible to be in contact with the user's skin during shaving.

Ease of Shaving

Shaving aid portions 31A, 31B have a width W at their widest point (FIG. 3B) that is equal to or slightly less than the width of the frame 36 of the holder 30. Thus, the shaving aid portions do not extend beyond the side walls of the frame 36. As a result, the area around the side walls of the frame is unobstructed, allowing the shaver to determine, by sight and/or tactile sensation, what area has been shaved. If desired, the shaving aid portions may extend slightly beyond the side walls of the frame, e.g., by 2 mm or less on each side.

Shaving is also facilitated by rails 61 (FIGS. 3, 4B), discussed above, which can engage the user's skin during shaving, potentially enhancing tracking of the cartridge.

Pivoting Cartridge/Handle Connection

As discussed above, referring to FIGS. 1 and 2, razor 10 includes a disposable cartridge 12 and a handle 14. As shown in FIG. 2, cartridge 12 includes a connecting member 18, which removably connects cartridge 12 to a connecting portion 19 of handle 14, and a blade unit 16, which is pivotally connected to connecting member 18.

Figure 6:
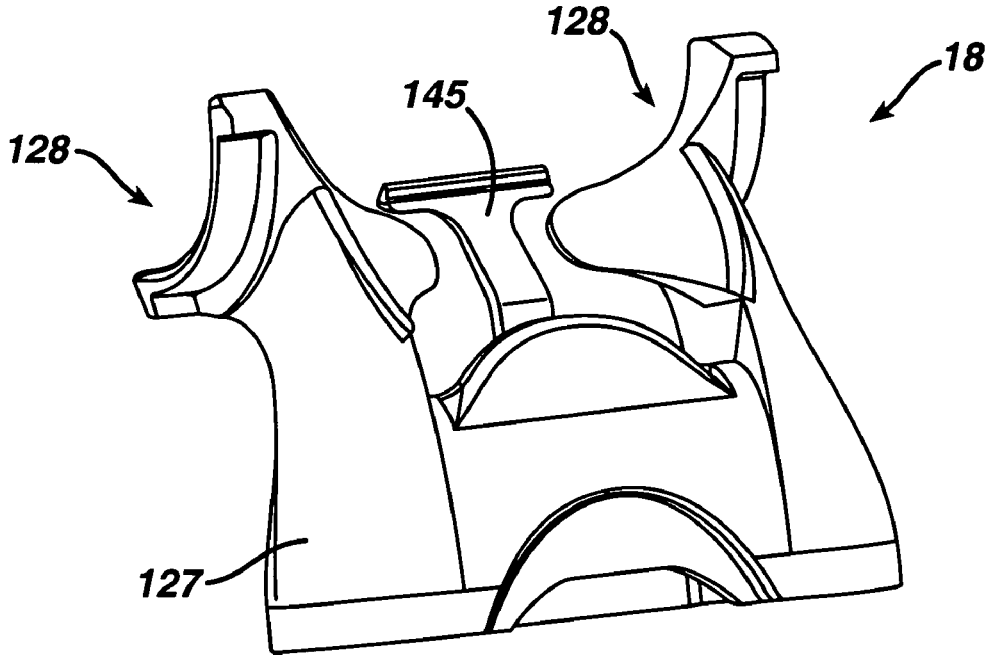
FIGS. 6 and 6A are perspective views of a connecting member used to connect the cartridge to the handle in the razor shown in FIG. 1, taken from different angles.
Figure 6A:
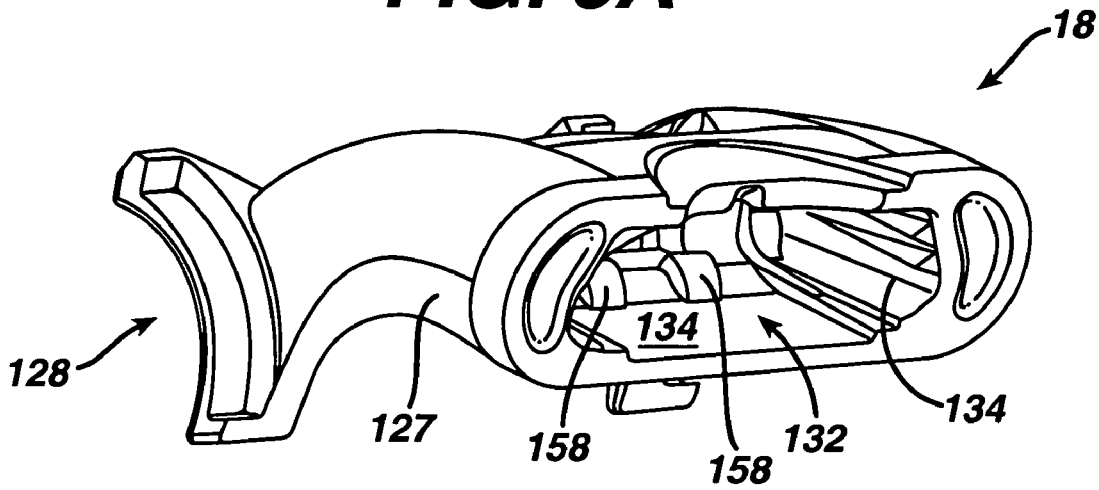
Figure 8:
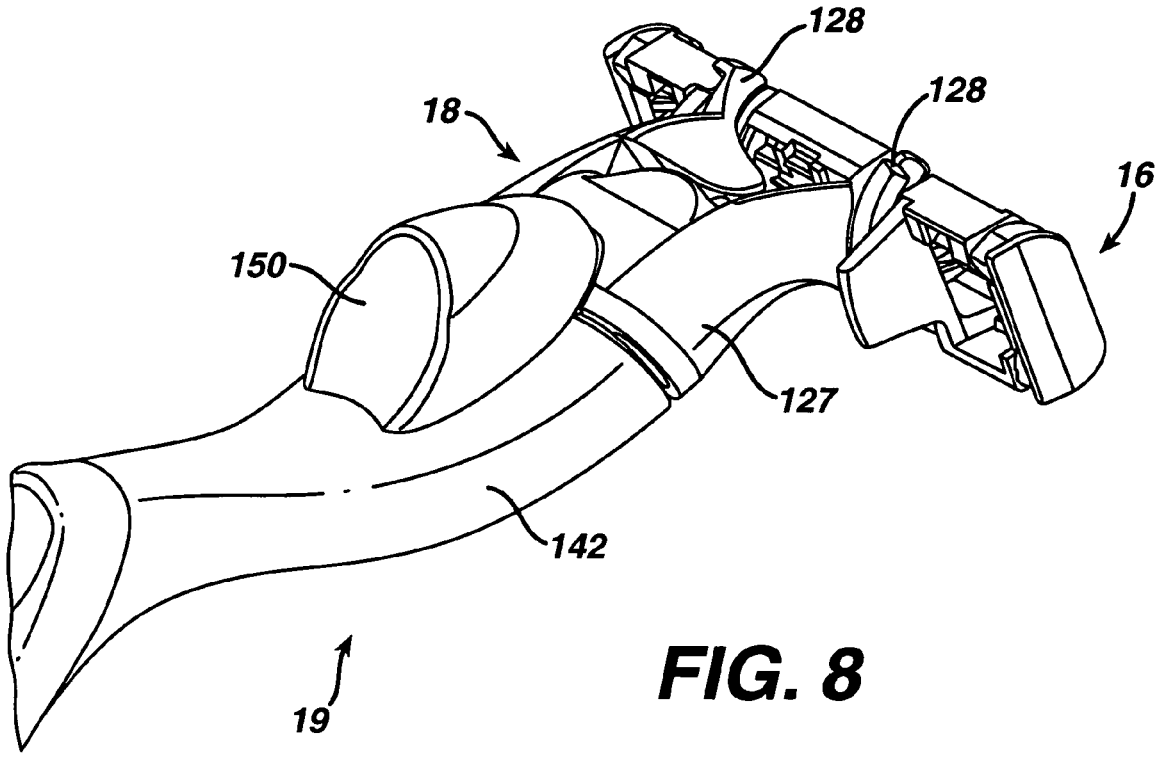
FIG. 8 is a perspective view, taken from the rear, of the blade unit of FIGS. 7 and 7A connected to a handle by the connecting member shown in FIGS. 6 and 6A.

Connecting member 18 is shown in detail in FIGS. 6-6A. Connecting member 18 includes a base 127, which removably and fixedly attaches to an extension 126 (FIG. 9) on handle 14, and two arms 128 that pivotally support blade unit 16 at its two sides, as shown in FIG. 8. Thus, base 127 connects to the connecting portion 19 of handle 14, while arms 128 connect to the blade unit 16, as will be discussed in further detail below. A flexible spring return 145 extends from base 127 and acts against a cam surface on blade unit 16, causing the blade unit 16 to have a forward-biased at-rest orientation. As shown in FIG. 2, the spring return includes a bend 200 that facilitates molding of the base 127.

First, the connection of the arms 128 to the blade unit 16 will be described, with reference to FIGS. 6-8.

Figure 7:
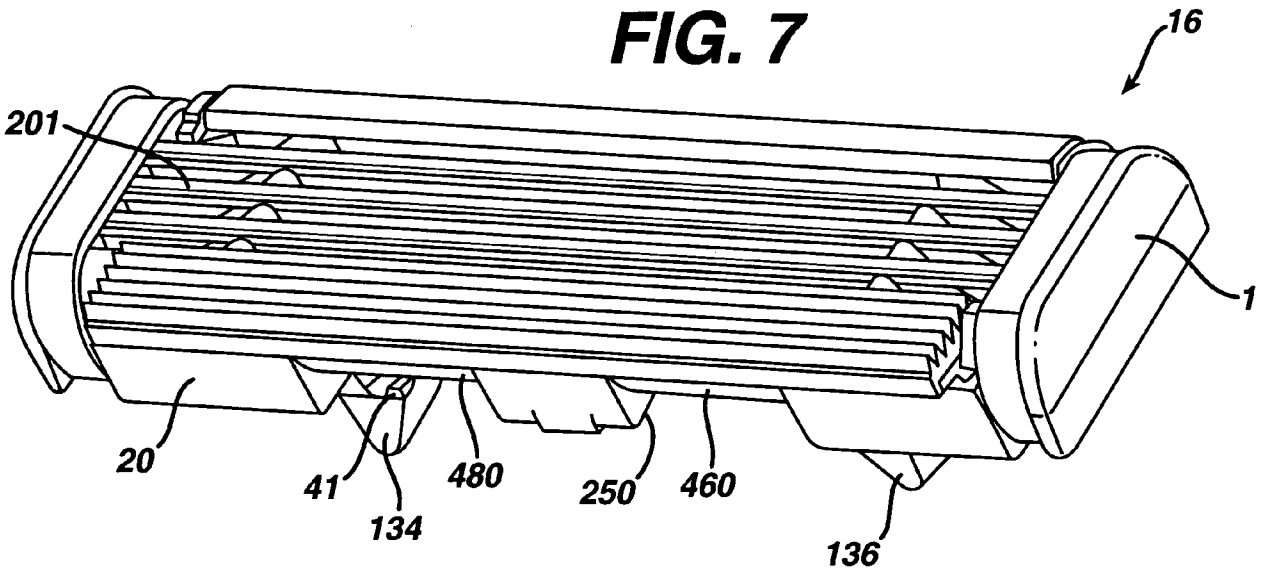
FIGS. 7 and 7A are, respectively, perspective and end views of the blade unit of the razor shown in FIG. 1.
Figure 7A:
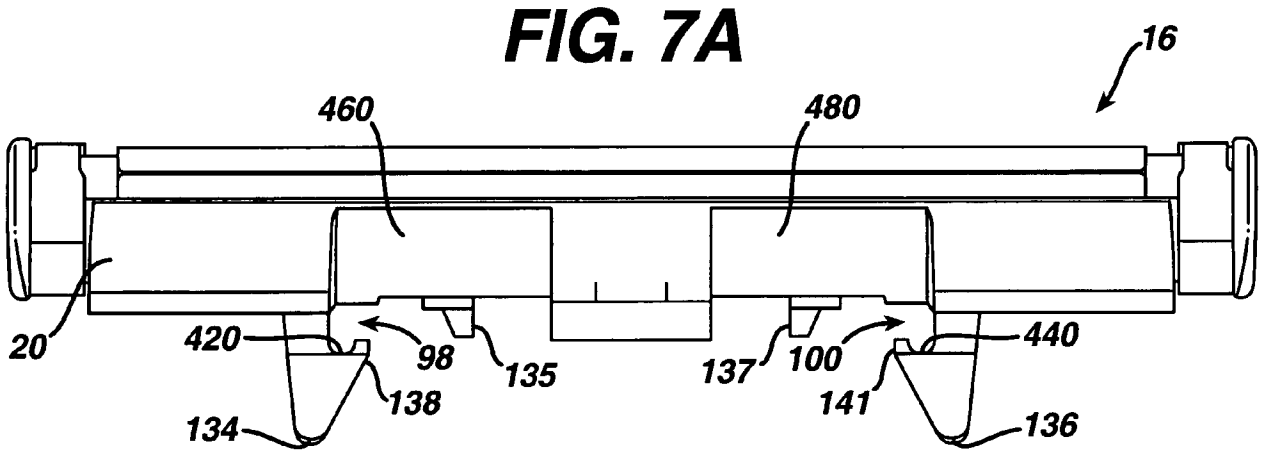

Referring first to FIG. 7A, extensions 134, 136 are located at the bottom of housing 20 of the blade unit. Extensions 134, 136 carry inwardly extending opposed curved rails 138, 141 having respective curved surfaces 420, 440. The undersurfaces 460, 480 of housing 20 are similarly curved and provide, with extensions 134, 136, a pivotal connecting structure, as described in detail in U.S. Pat. Nos. 4,488,357; 4,498,235; 4,492,025; 4,573,266; 4,586,255, 4,756,082 which are hereby incorporated by reference.

The curved rails 138, 141, in conjunction with undersurfaces 460, 480 of housing 20, define arcuate slots 98, 100, which are adapted to receive arms 128 of connecting member 18 (FIG. 6). Arms 128 define shell bearing surfaces which engage undersurfaces 460, 480. Thus, arms 128 or "shell bearings" cooperate with the surfaces 460, 480 to facilitate pivotal connection of the blade assembly to the razor handle 14. This mating engagement is referred to herein as a "shell bearing connection."

The top surfaces of rails 138, 141 and housing undersurfaces 460, 480 have radii of curvature about a pivot axis, which may be, for example, located at the cutting edge of the second blade 201 of the blade unit (FIG. 7). The curved surfaces 420, 440 of extensions 134, 136 are similarly curved about the pivot axis. Shaving aid holder 30 includes cut out areas 70 (FIG. 3A) to provide clearance for the pivoting movement provided by these complementary surfaces.

The shell bearings have stop surfaces (not shown) that provide a forward pivot stop position and a rearward pivot stop position, as described in U.S. Pat. No. 5,661,907. The shell bearings also have recesses (not shown) that mate with stop surfaces 135, 137 (FIG. 7A) formed on the respective curved undersurfaces 460, 480 to complement the rearward pivot stop position to prevent further "downward" travel.

Referring to FIG. 7, cam surface 250 is formed in the bottom of housing 20. Surface 250 has two oppositely inclined surfaces of the same size and an apex located at a position midway between the front and the back of cam surface 250. Cam surface 250 permits the blade unit to pivot forward or rearward to the same extent during shaving, and is adapted to receive spring 145 to bias the cartridge within the range of overall rotation, e.g., through a 40 to 45 degree arc.

Now, the connection of the base 127 to the connecting portion 19 of handle 14 will be described, with reference to FIGS. 6-6A and 9-11.

Figure 10:
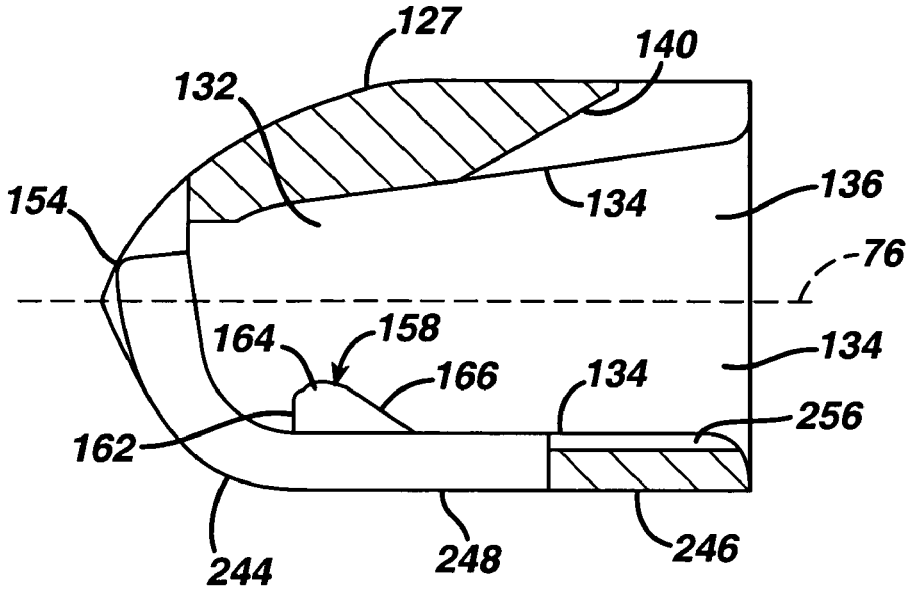
FIG. 10 is a cross-sectional view of the rear portion of the connecting member shown in FIGS. 6-6A.

Referring to FIGS. 6A and 10, base 127 has a handle-receiving region 132 that is partially defined by inwardly directed surfaces 134. Connection entrance 136 (FIG. 10) provides access to handle-receiving region 132. Inwardly directed surfaces 134 mate with outwardly directed surfaces 138 (FIG. 11) on extension 126 of handle 14. Base 127 also has an angled recess region 140 for receiving angled surface 142 on handle 14.

Figure 11:
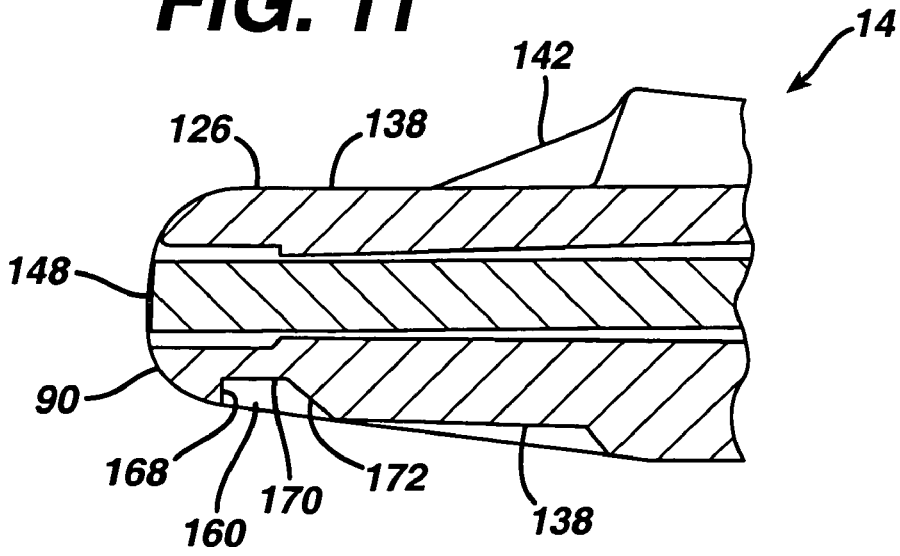
FIG. 11 is a cross-sectional view of the corresponding portion of the handle connecting structure shown in FIGS. 9-9A, taken along line 11-11 in FIG. 9A.

Referring to FIGS. 6A and 11, base 127 has a latching member 244 formed in the bottom wall 246 of the base. Latching member 244 has a cantilevered beam structure, and is connected to bottom wall 246 at base region 248. Latching member 244 tends to pivot upon being subjected to a force with an outward component at the free end at engagement members 154 (i.e., to the left along connection axis 76 in FIG. 10), as described in U.S. Pat. No. 5,956,851, incorporated by reference above. Bottom wall 246 also has grooves 256 to promote pivoting of latching member 44.

Two projections 158 (FIGS. 6A and 10) extend upward from latching member 244 for interacting with depressions 160 formed in the lower surface of extension 126 of handle 14 (FIG. 11). Each projection 158 has a front blocking surface 162, a top surface 164, and an angled camming surface 166, which makes about a 45 degree angle with connection axis 76 along which extension 126 moves during connection to and retraction from base 127. Other angles, e.g., between 30 and 60 degrees, could also be used. Depressions 160 similarly have front surfaces 168 for interacting with front blocking surface 162, top surface 170 and rear angled surface 172 for receiving top surface 164 and camming surface 166, respectively, of projections 158. Front blocking surface 162 of projection 158 makes about a 90 degree angle with connection axis 76.

The interaction of the components of handle 14 and cartridge 12 during connection and disconnection of cartridge 12 to handle 14 is discussed in further detail in U.S. Pat. No. 5,956,851, the disclosure of which is incorporated by reference above. Briefly, as extension 126 of handle 14 is moved into the handle-receiving region 132, sloping surface 90 (FIG. 11) of extension 126 rides over camming surface 166. This causes latch member 244, and in particular projection 158 thereon, to move downward along a deflection axis which is substantially perpendicular to connection axis 76 and the direction of insertion.

When sloping surface 90 has advanced past projection 158, and latching member 244 has moved up to the latched position in which projection 158 has snapped up into depression 160 of extension 126, cartridge 12 is securely attached to handle 14 with little likelihood of unintended detachment during use. The attachment is particularly secure due to interference of surface 168 (FIG. 11) on handle 14 with blocking surface 162 (FIG. 10) on cartridge 12. Surfaces 162 and 168 are substantially perpendicular to axis 76 along which extension 126 needs to be moved relative to base 127 to disconnect the two. Thus very large forces along axis 76 would need to be exerted to disconnect cartridge 12 from handle 14 if one does not first unlatch latching member 244.

Figure 9:
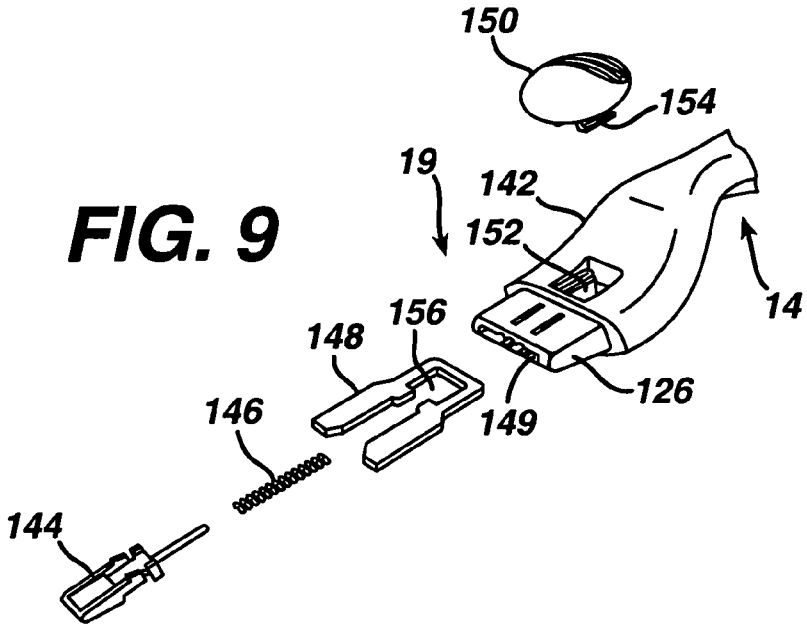
FIGS. 9-9B are, respectively, exploded, top and side views of a handle connecting structure at the upper end of the handle shown in FIG. 2.
Figure 9A:
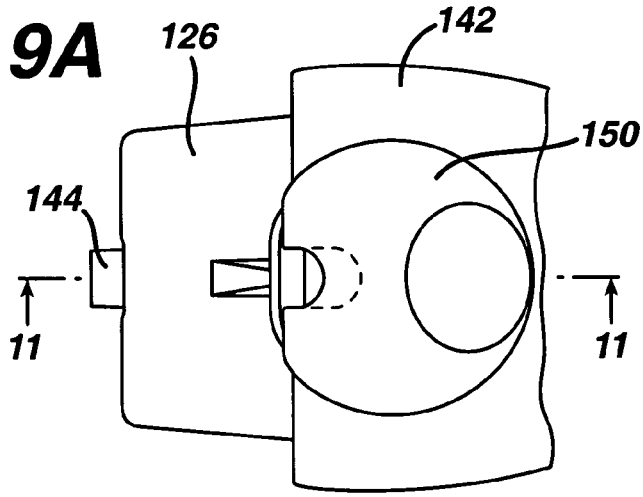
Figure 9B:
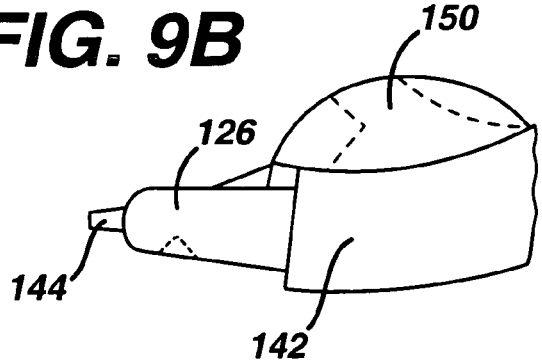

The connecting portion 19 of handle 14 is shown in detail in FIGS. 9-9B and 11. Referring to FIG. 9, a cartridge support structure 142 extends from the end of handle 14. Cartridge support structure 142 includes the trapezoidal extension 126, discussed above, and components that provide for ejection of cartridge 12 from handle 14.

Spring-biased plunger 144, spring 146, and U-shaped ejector 148 are received within recess 149 of cartridge support structure 142. Ejector button 150 is received in opening 152 on the top surface of support structure 142 and has bottom extensions 154 that are received within rectangular region 156 at the back narrow portion of ejector 148. These components are described in detail in U.S. Pat. No. 5,855,071, the disclosure of which was incorporated by reference above. Ejector 148 is slidably mounted within a recess within the handle connecting structure of handle 14, and can be moved forward slightly by activating button 150 on handle 14.

When the user wishes to disconnect cartridge 12 from handle 14, button 150 is moved relative to extension 126 in the unlatched direction, and this causes ejector 148 to be moved along axis 76 in the ejection direction. Ejector 148 (FIG. 11) pushes engagement members 154 outward, causing projection 158 to move downward as latching member 244 bends at base region 248. This downward movement causes projection 158 to clear depression 160 and to release extension 126 from latching member 244 so that extension 126 moves relative to base 127 in the retraction direction. A new cartridge may then be mounted on the handle by inserting the connecting portion 19 of the handle into the handle-receiving region 132 as discussed above.

Shaving Aid Formulations

Any desired formulation may be used to form the shaving aid portions. Preferably, the shaving aid portions have sufficient wear resistance so that the shaving aid portions last for the intended life of the cartridge. However, if desired, the shaving aid holder may be removable and replaceable by the consumer, in which case the shaving aid portions may be exhausted before it is necessary to replace the cartridge.

In some instances, the shaving aid portions may include soap, e.g., poured or extruded soap. Such soap-based compositions may be modified to increase their hardness, wear resistance, lubricity and/or skin moisturizing and conditioning properties.

Wear Indicators

If desired, the shaving aid portions may serve as a wear indicator, indicating to the user when the cartridge should be replaced. In the simplest implementation, the shaving aid portions can be formulated to be exhausted at the end of the intended life of the cartridge, as discussed above, so that running out of shaving aid will indicate to the user that the cartridge should be replaced. In other implementations, the shaving aid portions may include an embedded indicia, e.g., a logo or word, that appears when a predetermined amount of shaving aid has been washed away, or an indicia may be embossed on the shaving aid, which disappears as the shaving aid is used. In these cases, appearance or disappearance, respectively, of the indicia would indicate to the user that the cartridge should be replaced. Similarly, a lubricating strip may be mounted on one or both of the wings, underlying the shaving aid portion(s). In this case, as the shaving aid is exhausted the lubricating strip will be revealed, indicating that the cartridge should be replaced. The lubricating strip will provide the added benefit of lubrication and skin conditioning during the period of time until the user is able to replace the cartridge.

Other Embodiments

Other embodiments are within the scope of the following claims.

For example, while particular cartridge and handle types have been discussed above, the shaving aid holder may be used with any desired type of cartridge and/or handle. If a different cartridge shape is used, the shape of the frame of the shaving aid holder and/or the dimensions of the shaving aid holder may be adjusted accordingly.

Moreover, while two shaving aid portions are shown in the figures and described above, if desired the shaving aid holder may include only a single shaving aid portion, e.g., the front shaving aid portion if only a shave preparation composition is desired, or the rear portion if only skin conditioning is desired (for example, if the user will be using a separate shave preparation such as a bar of soap or a shave gel). In this case, the shaving aid holder will generally include only a single wing member and flexible hinge.

Additionally, while the wings described above include apertures to secure the shaving aid in place, solid wings may be used if the shaving aid exhibits adequate adhesion to the wings or is attached to the wings in a different manner. Also, while the flexible hinges described above are formed of an elastomeric material, in some cases the hinges may be formed of rigid plastic, e.g., "living hinges."

In some embodiments, the cartridge may include a cap with a lubricating strip, e.g., mounted in a slot at the rear of the cartridge housing. The lubricating strip may be made of a material comprising a mixture of a hydrophobic material and a water leachable hydrophilic polymer material, as is known in the art and described, e.g., in U.S. Pat. Nos. 5,113,585 and 5,454,164, which are hereby incorporated by reference.

What is claimed is:

1. A method of shaving comprising contacting the skin with a razor cartridge comprising a housing having a front edge and a rear edge;

a plurality of shaving blades between the front edge and the rear edge wherein each of said plurality of shaving blades has one sharp edge directed toward the front edge of said housing and one blunt edge directed toward the rear edge of said housing; and a shaving aid holder, mounted on said housing, carrying a first shaving aid portion in front of said sharp edges of said blades and carrying a second shaving aid portion behind said blunt edges of said blades, the shaving aid holder being configured to allow each shaving aid portion to deflect relative to said blades when pressure is applied to a surface of said first or said second shaving aid portion and to contact a user's skin at the same time during shaving.

2. The method of claim 1 comprising applying water to the skin during shaving.

3. A shaving cartridge comprising:

a housing having a front edge and a rear edge;

a plurality of shaving blades between the front edge and the rear edge wherein each of said plurality of shaving blades has one sharp edge directed toward the front edge of said housing and one blunt edge directed toward the rear edge of said housing; and a shaving aid holder, mounted on said housing, carrying a first shaving aid portion in front of said sharp edges of said blades and carrying a second shaving aid portion behind said blunt edges of said blades, the shaving aid holder being configured to allow each shaving aid portion to deflect relative to said blades when pressure is applied to a surface of said first or said second shaving aid portion and to contact a user's skin at the same time during shaving.

4. The shaving cartridge of claim 3 wherein the shaving aid holder includes a pair of wings, configured to support the first and second shaving aid portions.

5. The shaving cartridge of claim 4 further comprising an elastomeric portion mounted on the wings, positioned so that the elastomeric material will contact the user's skin when the first and second shaving aid portions are exhausted.

6. The shaving cartridge of claim 4 wherein each of said wings include at least one aperture configured to secure each of said shaving aid portions to a respective one of said wings.

7. The shaving cartridge of claim 4 wherein said wings extend downward, when the first and second shaving aid portions are in an undeflected position, relative to a plane defined by the front and rear edges.

8. The shaving cartridge of claim 3 wherein, when each of said shaving aid portions are deflected, no part of the shaving aid portions extend above a plane defined by the front and rear edges.

9. The shaving cartridge of claim 3 or 7 wherein, when the shaving aid portions are deflected, no part of the first and second shaving aid portions extends above a plane defined by the front and rear edges.

10. The shaving cartridge of claim 4 wherein the shaving aid holder includes a frame, and the wings are resiliently mounted on the frame.

11. The shaving cartridge of claim 10 further comprising a pair of flexible hinges that connect the wings to the frame.

12. The shaving cartridge of claim 11 wherein the hinges comprise an elastomeric material.

13. The shaving cartridge of claim 12 wherein the hinges include only the elastomeric material.

14. The shaving cartridge of claim 12 wherein the elastomeric material has a flexural modulus of from about 100 to 300 psi.

15. The shaving cartridge of claim 12 wherein the elastomeric material has a hardness of less than about 50 Shore A.

16. The shaving cartridge of claim 15 wherein the elastomeric material has a hardness of less than about 40 Shore A.

17. The shaving cartridge of claim 3 wherein each of said shaving aid portions are capable of deflection through an angle of deflection of at least about 10 degrees.

18. The shaving cartridge of claim 3 wherein the housing has a pair of side edges, and no part of the razor extends laterally beyond the side edges.

19. The shaving cartridge of claim 3 wherein the housing has a pair of side edges, and each of said shaving aid portions extend from 0 to 2 mm beyond the side edges.

20. The shaving cartridge of claim 3 wherein the shaving aid holder is configured to clip onto the housing.

21. The shaving cartridge of claim 20 wherein the shaving aid holder includes a frame, and inner edges of the frame overlap side edges of the housing.

22. The shaving cartridge of claim 20 wherein the shaving aid holder is configured to be removable from the housing.

23. The shaving cartridge of claim 20 wherein the shaving aid holder is configured to be attached to the housing.

24. The shaving cartridge of claim 3 wherein the shaving aid holder is integral with the housing.

25. The shaving cartridge of claim 1 wherein the first and second shaving aid portions have different compositions.

26. The shaving cartridge of claim 25 wherein one of the first and second shaving aid portions comprises a lubricious shaving preparation and the other of the first and second shaving aid portions comprises a skin conditioning preparation.

27. The A shaving cartridge of claim 3 wherein said first shaving aid portion is positioned forward of the front edge and includes a leading edge that is contoured to cause the first shaving aid portion to deflect upon skin contact, so that the cartridge will not rock back when the first shaving aid portion contacts the skin during shaving.

28. The shaving cartridge of claim 3 wherein either of said shaving aid portions is configured to provide an indication of wear to the user.

29. The shaving cartridge of claim 28 wherein either of said shaving aid portions includes an indicia that appears or disappears as the shaving aid is exhausted.

30. The shaving cartridge of claim 3 further comprising a lubricating strip that underlies either of the shaving aid portions.

31. A shaving razor comprising a handle, and, mounted on the handle, a cartridge comprising a housing having a front edge and a rear edge;

a plurality of shaving blades between the front edge and the rear edge wherein each of said plurality of shaving blades has one sharp edge directed toward the front edge of said housing and one blunt edge directed toward the rear edge of said housing; and a shaving aid holder, mounted on said housing, carrying a first shaving aid portion in front of said sharp edges of said blades and carrying a second shaving aid portion behind said blunt edges of said blades, the shaving aid holder being configured to allow each shaving aid portion to deflect relative to said blades when pressure is applied to a surface of said first or said second shaving aid portion and to contact a user's skin at the same time during shaving.

32. The razor of claim 31 wherein the cartridge is pivotally mounted on the handle.

33. The razor of claim 31 or 32 wherein the cartridge is removably mounted on the handle.

34. The razor of claim 32 wherein the cartridge includes a connecting portion having a handle receiving region configured to receive an end portion of the handle in interlocking engagement.

35. The razor of claim 34 wherein the connecting portion further includes a shell bearing connection that pivotally connects the housing to the connecting portion.

36. The razor of claim 32 wherein the shaving aid holder is configured to pivot with the cartridge.

37. A shaving razor comprising a handle, and, pivotally mounted on the handle, a cartridge comprising a housing having a front edge and a rear edge;

a plurality of shaving blades between the front edge and the rear edge wherein each of said plurality of shaving blades has one sharp edge directed toward the front edge of said housing and one blunt edge directed toward the rear edge of said housing; and a shaving aid holder, mounted on said housing, carrying a first shaving aid portion in front of said sharp edges of said blades and carrying a second shaving aid portion behind said blunt edges of said blades, wherein the shaving aid holder is configured to allow each shaving aid portion to pivot relative to said blades with the cartridge and to contact a user's skin at the same time during shaving.

38. The shaving razor of claim 37 wherein said shaving aid holder includes clearances to allow pivoting of the cartridge.

* * * * *

UNITED STATES PATENT AND TRADEMARK OFFICE

CERTIFICATE OF CORRECTION

PATENT NO. : 7,703,361 B2
APPLICATION NO. : 11/471903
DATED : April 27, 2010
INVENTOR(S) : Robert Johnson et al.

It is certified that error appears in the above-identified patent and that said Letters Patent is hereby corrected as shown below:

Please correct the name of one of the inventors. "Corby E. Corbeil" should be -- Corey E. Corbeil --.

Signed and Sealed this

Sixth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,703,361 B2
APPLICATION NO. : 11/471903
DATED : April 27, 2010
INVENTOR(S) : Robert Johnson et al.

It is certified that error appears in the above-identified patent and that said Letters Patent is hereby corrected as shown below:

Title Page, Item (75) Inventors

Please correct the name of the fourth inventor "Corby E. Corbeil" to read -- Corey E. Corbeil --.

This certificate supersedes the Certificate of Correction issued July 6, 2010.

Signed and Sealed this

Third Day of August, 2010

David J. Kappos

David J. Kappos
*Director of the United States Patent and Trademark Office*